United States Patent [19]

Edwards et al.

[11] Patent Number: 5,024,397

[45] Date of Patent: Jun. 18, 1991

[54] CLAMSHELL ATTACHMENT FOR LOG GRAPPLE

[75] Inventors: James C. Edwards, North Bend; Edward E. Pritchard, Reedsport, both of Oreg.

[73] Assignee: International Paper, Purchase, N.Y.

[21] Appl. No.: 479,771

[22] Filed: Feb. 14, 1990

[51] Int. Cl.[5] ..... B66C 3/02

[52] U.S. Cl. ..... 294/68.23; 37/117.5; 37/141 R; 37/186; 37/DIG. 3; 414/912

[58] Field of Search ..... 294/68.23; 37/117.5, 37/141 R, 183 R, 186, DIG. 3, DIG. 12; 414/569, 729, 912

[56] References Cited

U.S. PATENT DOCUMENTS 2,810,969 10/1957 Harris ..... 294/68.23 X 3,807,589 4/1974 Shovick ..... 37/117.5 X 4,907,356 3/1990 Labounty ..... 294/68.23 X

*Primary Examiner*—Johnny D. Cherry

*Assistant Examiner*—Andrew C. Pike

*Attorney, Agent, or Firm*—Walt T. Zielinski

[57] ABSTRACT

A clamshell attachment for a crescent shaped, concave-convex log grapple converts the log grapple to a scoop or bucket type device for handling bulk material such as wood chips. It consists of a pair of concave-convex scoops pivoted together at their upper ends. A holding pin connects each grapple half to a respective scoop, with the concave portion or side of each grapple half positioned over and adjacent the convex side of a respective scoop. The only modification required of the log grapple is the addition of apertured tabs to its convex sides, the tabs receiving the holding pins.

10 Claims, 2 Drawing Sheets

FIG. 5
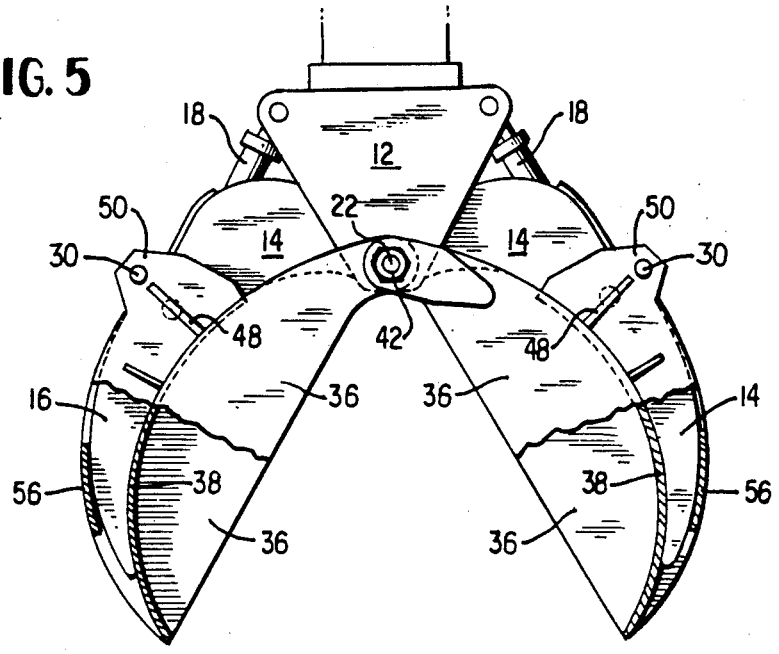
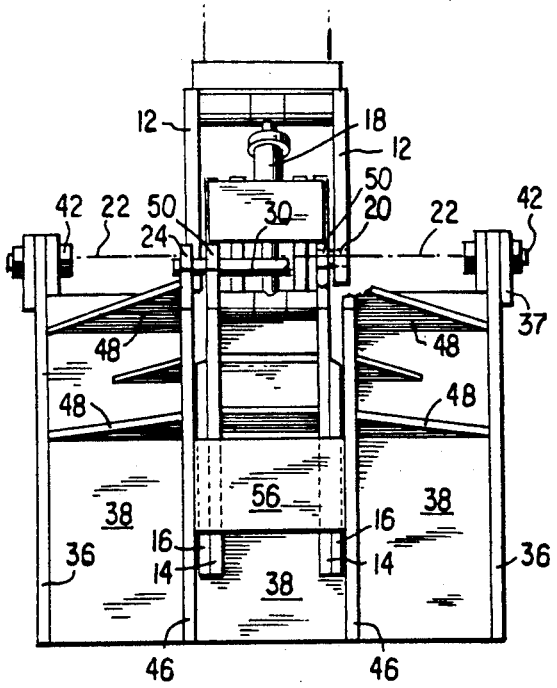
FIG 6
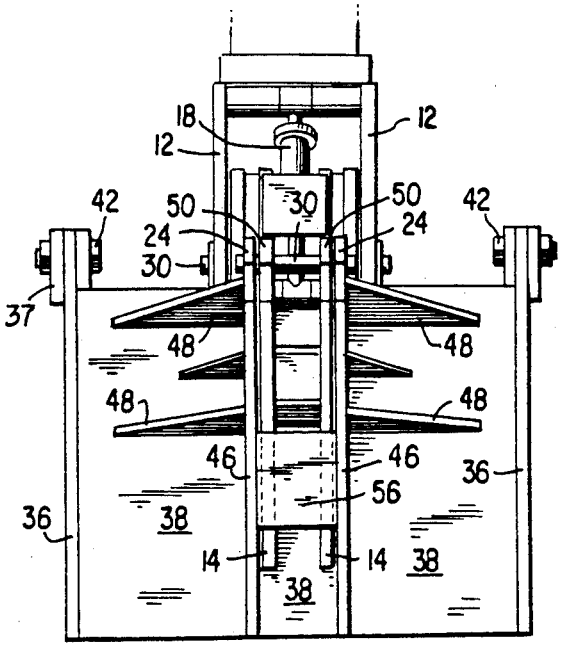
FIG. 7

CLAMSHELL ATTACHMENT FOR LOG GRAPPLE

BACKGROUND OF THE INVENTION

This invention relates to the art of material handling and more particularly to a clamshell attachment for adopting a log grapple to a scoop or bucket type grapple for handling bulk materials such as wood chips. This art is aware, in general, of attaching devices which convert one type of material handling machine to another type. For example, U.S. Pat. No. 3,807,589 issued to Schovick describes a bucket attachment for a backhoe.

However, no such attachment is known in the log grapple field. Typically, a log grapple includes a first pair of crescent, concave-convex shaped plates which are arranged in parallel and are attached, at their upper ends, to a common axis on a frame. The frame carries hydraulic motors for rotating each pair of crescent shaped legs about the common axis. Because each leg of such a log grapple is defined by a pair of spaced, curved steel plates, a log grapple is not suitable for handling bulk materials, such as wood chips.

SUMMARY OF THE INVENTION

According to the practice of this invention, a conventional log grapple is easily converted into use as a bulk handling device by the addition by a pair of pivoted together concave-convex scoop elements. Preferably, the pivot axis of the scoops is coincident with the pivot axis of the legs of the log grapple. The legs of the log grapple are slightly modified by the addition of apertured tabs, typically welded thereon, with each half of the log grapple fitted around the convex surface of a respective scoop. A holding pin connects each half of the log grapple to a respective scoop. For the protection of the lower portions of the log grapple, a pocket may be provided on the outside or convex surface of each scoop. To convert the log grapple to a scoop or bulk handling type device, sometimes termed a clamshell type scoop, it is only necessary to place each leg of the log grapple over the convex surface of a respective scoop and insert a holding pin therein, the holding pin also passing through a respective bracket on a respective scoop.

BRIEF DESCRIPTION OF THE DRAWINGS

FIG. 5 is a front elevational view showing the clamshell attachment of FIG. 3 attached to the log grapple of FIG. 1.

FIG. 6 is a partially broken side elevational view taken from the left of FIG. 5.

FIG. 7 is a side elevational view taken from the right of FIG. 5.

DETAILED DESCRIPTION OF THE INVENTION

Figure 3:
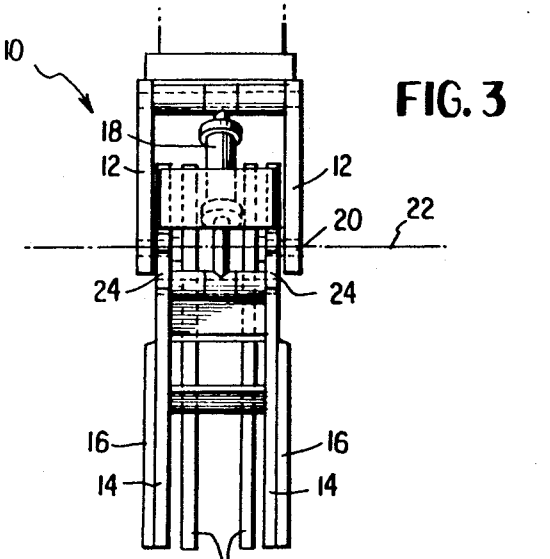
FIG. 3 is a side elevational view of the grapple of FIG. 1.
Figure 1:
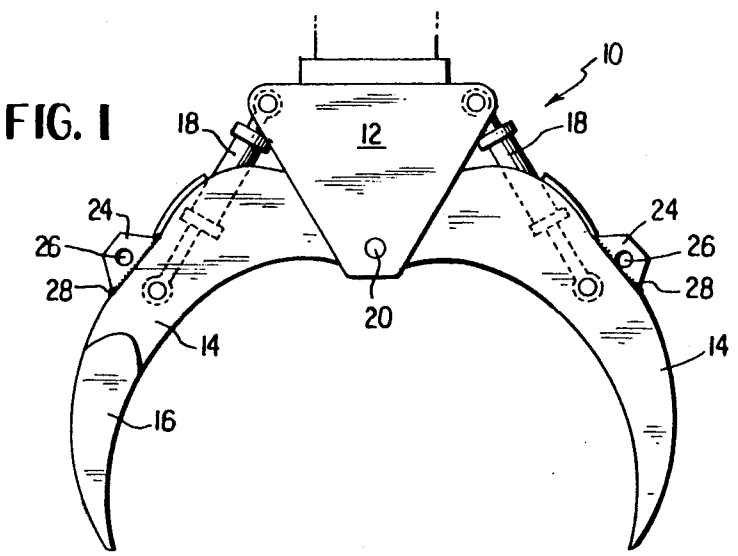
FIG. 1 is a front elevational view of a typical log grapple modified in accordance with this invention.

Referring now to FIGS. 1 and 3 of the drawings, the numeral 10 denotes generally a typical log grapple, of known construction, as modified by this invention. The numeral 12 denotes a pair of spaced plates, being parts of a conventional log grapple. The numeral 14 denotes any one of four crescent shaped, curved, concave-convex, legs of the log grapple, with the legs of each jaw half being in parallel, spaced relation to each other. The outside, lower surface of each of the left hand pair of log grapple legs 14 (as viewed at FIG. 1) is provided with a spacer plate 16, typically welded thereto. This is also seen at FIG. 3 of the drawings.

A hydraulic motor 18 is conventionally attached between the frame of the grapple and a respective grapple jaw half for pivoting each grapple jaw about a common axis 20. A tab 24, typically of steel sheet of the same thickness of each leg 14, is provided with an aperture 26, with each tab being welded, as indicated at 28, to its respective leg 14. The addition of tabs 24 to the grapple shown at FIGS. 1 and 3 is the only modification required to convert an otherwise conventional log grapple to one which will accept the clamshell attachment of this invention.

Figure 4:
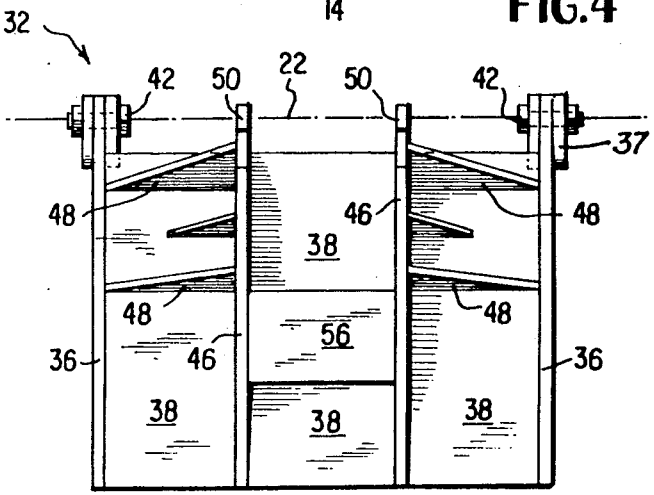
FIG. 4 is a side elevational view of FIG. 2.
Figure 2:
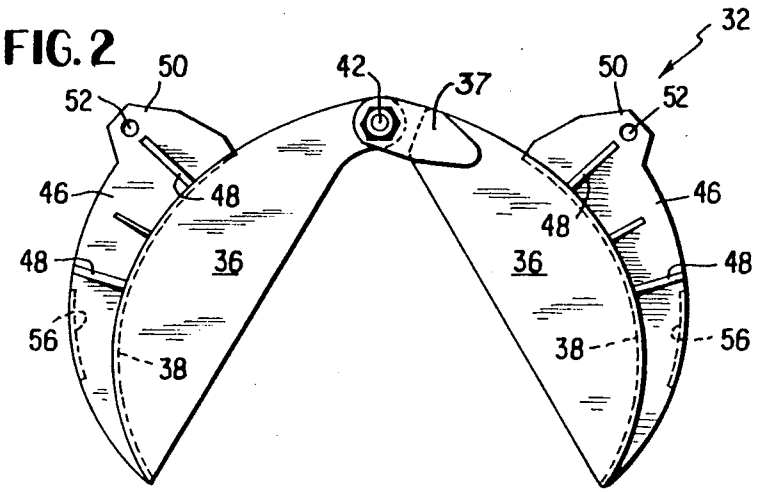
FIG. 2 is a front elevational view of the clamshell attachment of this invention.

Referring now to FIGS. 2 and 4, the numeral 32 denotes the clamshell or scoop attachment of this invention. Each scoop includes a concave-convex wall 38 having at either end a sector shaped end plate 36. The combination of end plates 36 at the ends and curved wall 38 defines a hollow scoop. The upper portions of end plates 36 are provided with apertures, the apertures receiving threaded fasteners 42, the latter functioning as hinge or pivot elements to hingedly connect the two halves of the scoop together. If desired, an abutment plate 37 may be provided exteriorly of each fastener 42 If desired, abutment plate 37 may be welded to its corresponding end plate 36.

The convex side of each scoop is provided with a pair of reinforcing brackets 46, typically fashioned of sheet steel and maintained in a 90 degree relationship to wall 38 by reinforcing members 48 as by welding. The upper portion of each bracket 46 is provided with a tab 50, the latter having an aperture 52. Tabs 50 are illustrated as intregal with the remainder of each bracket 46 or they may be welded on, as are tabs 24 shown at FIG. 1. A steel plate 56 is secured, as by welding, between portions of each pair of spaced brackets 46 on each respective clamshell half. The space between the interior surface of plate 56 and its facing part 38 of each half forms a pocket or recess for the reception of the lower portions of each half of legs or jaws 14 of log grapple 10.

As seen from a comparison between FIGS. 6 and 7, the spacing between the pairs of brackets 46 on the left half of the attachment is greater than the corresponding spacing on the right half. This follows from the fact that, as soon will be apparent, the width of the two legs of the log grapple is different.

Referring now the FIGS. 5–7 of the drawings, the assembly of the attachment on the log grapple is illustrated. It will seen that the lower portions of the tongs of the log grapple are received by the space between plates 56 and the respective curved walls 38 of each scoop. A holding pin 30, the ends of which are typically provided with through openings to receive a cotter pin (not illustrated), extends through aligned openings 26 and 52 of, respectively, tabs 24 and 50 of, respectively, corresponding grapple and attachment halves. This is clearly seen at FIGS. 6 and 7 wherein, at FIG. 6, a holding pin 30 passes through the apertures in corresponding tabs 24 and 50, while in FIG. 7, on the other half of the assembly, another holding pin 30 passes through aligned tabs 24 and 50. The numeral 22 denotes the common axis of hinges or pivots 42 and 20. Pivot axis 20 is not seen in FIGS. 6 or 7.

In operation, upon actuation of hydraulic motors 18, the legs or jaws 14 of log grapple 10 pivot about axis 20. By virtue of the connection between openings 26 and 52 afforded by holding pins 30, the pivoting action is transmitted to clamshell attachment 32, with the latter pivoting about 42. It is preferable, as noted above, that axes 20 and 42 be coincident as indicated at 22 of FIG. 6. This is to prevent binding of the curved scoops or clamshell halves upon pivoting relative to each other.

In theory, one could omit the pivot 42 between the two scoop halves, particularly by making the pocket between plates 56 and curved walls 38 snug with respect to the lower ends of the grapple jaws. However, this would entail practical difficulties due to the fact that in operation a relatively incompressible object, such as a rock, may be pinched by the lower edges of the scoops and unless the rock were in the geometrical center of the lower scoop edges, a torque would be applied to the log grapple. Without hinges 42, this torque would be transmitted to the jaws or legs of log grapple 10 and the grapple might be damaged due to twisting of its jaws or legs 14. Thus, the action of hinges 42 is to maintain a torque free load on jaws 14 of grapple 10, so that the only resistance such jaws will encounter in opening is always in the plane of the grapple as defined by the plane of swinging of the jaws towards and away from each other. Also, plates 56 may, if desired, be omitted, although it has been found that they function to protect the lower portions of the grapple jaws.

We claim:

1. A clamshell attachment for a log grapple, the attachment adapted to be added to a log grapple having a pair of pivoted jaws to convert the log grapple into a clamshell grapple for scooping bulk material, the attachment including a pair of concave-convex scoops, said scoops having aligned hinges which couple upper portions thereof of each scoop together about an upper common axis so that the scoops are hinged together at the upper portions thereof, a convex side of each scoop provided with means for coupling a respective said log grapple jaw thereto, wherein the convex side of each scoop is also provided with a pocket to receive a portion of said respective jaw of the log grapple.

2. A clamshell attachment for a log grapple, the attachment adapted to be added to a log grapple having a pair of pivoted jaws to convert the log grapple into a clamshell grapple for scooping bulk material, the attachment including a pair of concave-convex scoops, said scoops having aligned hinges which couple upper portions thereof of each scoop together about an upper common axis so that the scoops are hinged together at the upper portions thereof, a convex side of each scoop provided with means for coupling a respective said log grapple jaw thereto, said means including a pair of apertured, spaced brackets on said convex side of each scoop, the brackets adapted to receive at least a portion of said respective jaw of the log grapple, a spacing between each bracket of said pair of brackets on one scoop being different from a spacing between each bracket of said pair of said brackets on the other scoop.

3. The attachment of claim 2 further including a plate spanning each said pair of brackets of each scoop, each plate being spaced from a convex surface of a respective said scoop to thereby define a pocket to receive respective said portion of the respective jaw of the log grapple.

4. The combination of a log grapple and a clamshell attachment, the log grapple including opposite, crescent shaped, concave-convex jaws pivoted together about a pivot for opening and closing and also including means to open and close them, a clamshell attachment attached to the log grapple and including a pair of concave-convex clamshell scoops having hinges and hinged together, and means carried by each scoop for coupling each scoop to a concave portion of a respective said grapple jaw, wherein the scoops rotate about the hinges thereof with rotation of the grapple jaws about the grapple jaw pivot.

5. The combination of claim 4 wherein the log grapple pivot is coaxial with the scoop hinges.

6. The combination of claim 5 wherein said log grapple jaw pivot is positioned between said scoop hinges.

7. The combination of claim 4 wherein said means for coupling each scoop to the respective log grapple jaw includes a holding pin extending through both a portion of a respective said scoop and a portion of the respective jaw, the holding pins each located on a convex side of the respective scoop.

8. The combination of claim 7 wherein each scoop carries a pair of brackets on the convex side thereof and wherein each grapple jaw carries a pair of brackets on a convex side thereof and wherein a respective said holding pin passes through a respective said pair of said brackets.

9. The combination of claim 8 wherein a spacing between each bracket of said pair of said brackets on one scoop is different from a spacing between each bracket of said pair of said brackets on the other scoop.

10. The combination of claim 4 further including a pocket on a convex side of each scoop, each pocket of each scoop receiving said portion of the respective jaw of said log grapple.

* * * * *